US005851655A

United States Patent [19]

Tokiyoshi et al.

[11] Patent Number: 5,851,655

[45] Date of Patent: Dec. 22, 1998

[54] RECEIVING PAPER FOR MELT-TYPE HEAT TRANSFER RECORDING

[75] Inventors: Tomofumi Tokiyoshi, Soka; Hitoshi Ishizawa, Chiba; Masaru Kato, Yokohama, all of Japan

[73] Assignee: OJI Paper Co., Ltd., Tokyo, Japan

[21] Appl. No.: 791,621

[22] Filed: Jan. 31, 1997

[30] Foreign Application Priority Data

Feb. 2, 1996 [JP] Japan ..... 8-017306

[51] Int. Cl.[6] ..... B41M 5/38

[52] U.S. Cl. ..... 428/330; 428/195; 428/207; 428/211; 428/304.4; 428/409; 428/913; 428/914

[58] Field of Search ..... 428/195, 207, 428/211, 323, 330, 913, 914

[56] References Cited

U.S. PATENT DOCUMENTS 5,302,576 4/1994 Tokiyoshi et al. ..... 503/227

OTHER PUBLICATIONS

Patent Abstracts of Japan, vol. 11, No. 155 (M–589), May 20, 1987, JP–A–61 286187, Dec. 16, 1986.

Patent Abstracts of Japan, vol. 17, No. 414 (M–1456), Aug. 3, 1993, JP–A–05 085071, Apr. 6, 1993.

Patent Abstracts of Japan, vol. 15, No. 328 (C–860), Aug. 21, 1991, JP–A–03 124896, May 28, 1991.

*Primary Examiner*—Bruce H. Hess

*Attorney, Agent, or Firm*—Oblon, Spivak, McCelland, Maier & Neustadt, P.C.

[57] ABSTRACT

The present invention provides a receiving paper for melt-type heat transfer recording suitable for use in, for example, a copying machine, a printer and a fascimile machine employing heat transfer recording system using heat meltable ink, which paper is excellent in ink receptivity and dot reproducibility and high in performance and quality in recorded image. The receiving paper of the present invention for melt-type heat transfer recording comprises a base paper and an image receiving layer thereon, the receiving layer containing a binder and a pigment and receiving a heat-meltable ink, wherein the receiving layer contains spherical precipitated calcium carbonate having an average particle diameter of 0.5 to 10 $\mu$m as a pigment, and wherein the surface of the receiving layer has a surface roughness (Rmax) of 0 to 15 $\mu$m as measured according to JIS K 0601, a pore open area ratio of 30 to 85% and an average pore open area of 0.5 to 20.0 $\mu m^2$.

17 Claims, No Drawings

RECEIVING PAPER FOR MELT-TYPE HEAT TRANSFER RECORDING

BACKGROUND OF THE INVENTION

The present invention relates to a receiving paper for melt-type heat transfer recording suitable for use in, for example, a copying machine, a printer and a fascimile machine employing heat transfer recording system using heat meltable ink (hereinafter referred to simply as "receiving paper"), especially to a receiving paper which is excellent in ink receptability and dot reproducibility and provides recorded image having high recording quality.

As the recent progress in office automation, machines such as copying machines, printers and facsimile machines employing various recording systems such as electrophotographic system and heat transfer recording system have been widely used depending on their applications. In the image formation in these systems, coloring agents or materials are used. Generally, the coloring materials are melted, evaporated or sublimated to be transferred onto a recording medium such as paper and a film sheet and to form recorded image by adhesion, adsorption or dyeing thereof onto such recording medium.

Among these systems, much attention has been recently paid to heat transfer recording system using heat meltable ink, wherein the heat meltable ink layer of an ink ribbon or ink sheet is melted by heat on the thermal head and coloring materials are transferred to a recording medium, whereby forming recorded image. In this system, it is advatageous that plain paper can be used as a receiving paper.

In this system, there has been increased demand for, e.g., full color recording, high speed recording, clear image formation and high resolution in the same manner as in the other systems. However, this demand cannot be sufficiently fulfilled by plain paper. When multicolor recording is made using, for example, a color heat transfer printer, an ink ribbon having color materials such as yellow, magenta, cyan and black materials, as well as waxes and resins is combined with a recording medium and they are treated on a thermal head to form a transferrd image onto the recording medium. In the full color recording, different color inks are superimposed on each other. Accordingly, if plain paper is used as a receiving paper, there likely take place problems such as unevenness in transfer and dot loss, because of the smoothness and ink receptivity of an ink image receiving layer surface.

For solving the above mentioned problems, there have been proposed the techniques, for example, that the Bekk smoothness of a receiving paper is specified in order to improve the surface smoothness thereof as disclosed in Japanese Patent Unexamined Publication (Kokai) No. 60-110488; and that a heat transfer receiving layer containing a specific pigment and binder is provided as disclosed in Kokai Nos. 60-110489 and 60-110490. However, while these techniquies provide improved effect to some extent, decrease in image clarity caused by uneven color transfer or color discrepancy on the superimposed color ink portion or by transfer ink dotting loss and deficiency in reproducibility in dot shape in the case of multicolor recording is not sufficiently inhibited. Mere intensified smoothing treatment to enhance the smoothness or mere inclusion of a pigment or a binder in a heat transfer receiving layer is insufficient. Up to now, there has not been proposed any receiving paper which resolves the above mentioned problems and provides excellent ink transferring property and dot reproducibility as well as a high recorded image quality.

SUMMARY OF THE INVENTION

Accordingly, it is an object of the present invention to provide a receiving paper for use in a melt type heat transfer recording system, in particular, to provide a receiving paper which is excellent in ink receptivity, reproducibility, fixability, gradation and clarity (without generating any broadening of a dot and dot bridging), and which provides high performance and high quality recorded image.

The inventors of this invention have conducted intensive studies to accomplish the foregoing object and, as a result, have found out that the use of the specific spherical precipitated calcium carbonate as a pigment in the ink receiving layer and the provision of the specific surface roughness, pore open area ratio and average pore open area of the receiving layer provide excellent effect that cannot be expected from the prior art. The present invention has been completed on the basis of this finding.

Specifically, the present invention relates to a receiving paper for melt-type heat transfer recording comprising a base paper and an image receiving layer thereon, the receiving layer containing a binder and a pigment and receiving a heat-meltable ink, wherein the receiving layer contains spherical precipitated calcium carbonate having an average particle diameter of 0.5 to 10 $\mu$m as a pigment, and wherein the surface of the receiving layer has a surface roughness (Rmax) of 0 to 15 $\mu$m as measured according to JIS B 0601, a pore open area ratio of 30 to 85% and an average pore open area of 0.5 to 20.0 $\mu m^2$. The symbol in JIS-B-0601 corresponding to (Rmax) is $R_y$.

The more preferred embodiments of the present invention are as follows:

1. In the receiving paper above, the spherical precipitated calcium carbonate is spherical aggregate composed of cubic fine particles having one side of 0.05 to 0.8 $\mu$m in length.
2. In the receiving paper above, the receiving layer further contains calcined clay as a pigment.
3. In the receiving paper above, the receiving layer has a percent proportion of accumulated pore volume of the pores having a pore diameter of 0.8 to 6 $\mu$m per total accumulated pore volume being 40 to 100% and wherein the components of the receiving layer have a heat diffusion coefficient of $1.0\times10^{-3}$ to $2.4\times10^{-3}$ $cm^2$/sec.
4. In the receiving paper above, the surface of said receiving layer is treated with a metal roll of a smoothing device comprising said roll and an elastic roll meeting the following conditions (1) and (2):
   (1) the surface Shore D hardness is 75 to 98 degree as measured according to JIS K 6301 and 7215.
   (2) the surface roughness (Rmax) is 0 to 25 $\mu$m as measured according to JIS B 0601.

DESCRIPTION OF THE PREFERRED EMBODIMENTS

The present invention will hereinafter be described in more detail.

The spherical precipitated calcium carbonate usable in the present invention includes ED-I, ED-III and ED-110 manufactured by Komesho Sekkai Kogyo and B-1002 manufactured by Tsukumi Fineceramics Kenkyu Center.

The average particle diameter of the spherical precipitated calcium carbonate is 0.5 to 10 $\mu$m, preferably 0.5 to 6 $\mu$m, more preferably 1 to 6 $\mu$m. When the average particle diameter is less than 0.5 $\mu$m, the image receiving layer has less vacant space and accordingly, is less ink receptive. On the other hand, when the average particle diameter is larger than 10 μm, the image receiving layer has less surface smoothness and accordingly, problems such as dot loss likely take place and the recorded image quality is apt to be reduced.

The spherical precipitated calcium carbonate usable in the present invention is preferably spherical aggregate composed of cubic fine particles having one side of 0.05 to 0.8 μm. In this case, the particle diameter of the pigment is determined based on the observation by an electron microscopy. The oil absorbency of the spherical precipitated calcium carbonate is preferably in the order of 25 to 80 ml/100 g as measured according to JIS K 5101. With such oil absorbency, the image receiving layer becomes more ink receptive.

In order to improve the ink receptivity of the image receiving layer, it is necessary to improve the ink absorbency and ink transferability. The ink absorbency is mainly depending on the vacant space of the ink image receiving layer and the oil absorbency of the pigment. The ink transferability depends on the smoothness of the ink image receiving layer. Therefore, the image receiving layer which has more vacant space and higher surface smoothness is expected to be effective in ink absorbency and ink transferability. However, if the oil absorbency of the pigment is too high, the dot broadening and bridging are caused.

In general, calcium carbonate can be classified into ground calcium carbonate and precipitated calcium carbonate. Ground calcium carbonate can be prepared by pulverizing natural limestone by dry or wet system. The particle diameter and its distribution can be controlled by the pulverization conditions. Precipitated calcium carbonate can be prepared by dissolving quick line in water and blowing carbon dioxide gas thereinto. The particle shape, paricle diameter, its distribution and crystal form can be changed by the reaction conditions. As a crystal form of precipitated calcium carbonate, there are three forms, i.e., calcite (hexagonal or cubic), aragonite (rhombohedral) and vaterite (hexagonal). Among them, vaterite is unstable as crystal and accordingly, is scarcely industrially used. Aragonite is of slender column form. Calcite crystal includes primary particles of various forms such as spindle form and cubic form. Further, calcite crystal includes secondary particles wherein the primary particles are aggregated or fused.

The spherical precipitated calcium carbonate usable in the present invention is preferably aggregated matter of primary crystal of cubic calcite crystal.

Recently, there has been progress in reducing minimum dot diameter in order to accomplish especially high resolution image. Further, a printer providing a dot of a minimum dot diameter in the order of 10 to 20 μm has been developed. In order to stably transfer such a minimum diameter dot onto the image receiving layer surface, it is necessary to reduce the unevenness of a receiving surface. In the color recording, it is necessary for a color dot in a lower positioned ink to be efficiently received by an ink image receiving layer in a stable form (e.g., without causing dot loss and bleeding). In this case, when a superimposing ink is charged, the lower positioned ink is fused again and easy to diffuse or bleed in a three-dimentional manner. Therefore, it is also necessary to inhibit the diffusion of the lower positioned ink in the superimposed color portion.

In the present invention, in order to stably receive a single color dot and to inhibit the diffusion of the lower positioned color dot in the superimposed color portion, the smoothness of an image receiving layer surface is improved and there is provided sufficient vacant space comprised of pore portions of suitable size in the image receiving layer surface in order to rapidly absorb the fused ink.

In the present invention, the ink image receiving layer has a surface roughness (Rmax) of 0 to 15 μm, preferably 0 to 13 μm as measured according to JIS B 0601, a pore open area ratio of 30 to 85%, preferably 50 to 85%, on the surface and an average pore open area of 0.5 to 20.0 $\mu m^2$, preferably 0.5 to 15 $\mu m^2$. When the pore open area ratio is less than 30%, there is less pore open portion for receiving dots and accordingly, the lower positioned dot in the multicolor printing portion broadens. On the other hand, when the pore open area ratio is lager than 85%, the strength of the receiving layer becomes less. Even if the pore open area ratio is within the range of 30 to 85%, when the average pore open area is less than 0.5 $\mu m^2$, the permeation powder of the ink is reduced. On the other hand, when the average pore open area is larger than 20.0 $\mu m^2$, the surface unevenness becomes larger and accordingly, it is difficult to transfer a single color dot in a stable form (causing dot loss, etc.), although the ink is easy to permeate and the diffusion of the lower positioned dot is inhibited. The term "pore open area ratio" used in the specification means a ratio of the total area occupied by the pore open area per the total area of the porous ink image receiving layer surface.

The method for determining the average pore open area and pore open area ratio is not limited. For example, they are determined by taking a photograph of the ink image receiving layer surface using a scanning electron microscope (×1000) and then conducting the determination by Image Analyzer V10 manufactured by Toyobo Co., Ltd.

In order to improve a transfer property of a heat meltable ink and to improve an ink receptivity on an image receiving layer, it is preferable that the heat insulation of the image receiving layer is enhanced so as to efficiently reduce the viscosity of the ink to be transferred. On the other hand, in order to rapidly absorb the melted ink, it is preferable that there should be present sufficient vacant space composed of pore portion of suitable size in the image receiving layer.

In the present invention, it is preferable that a percent proportion of the total accumulated pore volume of the pores having a pore diameter of 0.8 to 6 μm per the total accumulated pore volume in an image receiving layer (hereinafter referred to as "pore volume %") should be at least 40%, in order to remarkably improve the ink receptibility. More preferably, the pore volume % should be 60 to 100%. The pores having a diameter of less than 0.8 μm will cause insufficient heat insulation, leading to generation of dot loss. On the other hand, the pores having a diameter of larger than 6 μm sometimes will cause insufficient interlayer strength of the ink receiving layer.

The components of the ink image receiving layer preferably have a heat diffusion coefficient of $1.0\times10^{-3}$ to $2.4\times10^{-3}$ $cm^2$/sec., preferably $1.0\times10^{-3}$ to $2.0\times10^{-3}$ $cm^2$/sec., in order to provide extremely uniform dots of recorded image in a stable form. When the coefficient is larger than $2.4\times10^{-3}$ $cm^2$/sec., the heat insulation of the image receiving layer is insufficient and therefore, the dot loss or partial loss is apt to happen, likely leading to fail to transfer the dot in a uniform shape. When the coefficient is less than $1.0\times10^{-3}cm^2$/sec., the heat insulation of the image receiving layer is too large and therefore, the dot is apt to diffuse and the dot shape is apt to be non-uniform. In addition, in this case, staining on a white portion is easy to take place, leading to less quality image.

The pore distribution (differential curve) of the image receiving layer can be determined by calculation based on a vacant space volume distribution curve measured according to mercury pressure penetration method using a porosimeter (tradename: Micrometric Poresizer 9320, manufactured by Shimazu Seisaku-sho). The pore diameter by the mercury pressure penetration method is derived based on the following equation (1) assuming that the cross-section of the pore is round.

$$D=-4\gamma COS\theta/P \quad (1)$$

In the equation, D means a pore diameter; $\gamma$ means a surface tension of mercury; $\theta$ means a contact angle; and P means a pressure imposed on mercury. In the determination, the surface tension of mercury is 482.536 dyn/cm, the contact angle is 130 degree, and the pressure for marcury is varied over 18 to 3600 psia. A sample for determination of a pore diameter distribution curve was prepared by coating one side of a base paper with an image receiving layer and, if necessary, provided cellophane tape on the backside of the base sheet (opposite side to the image receiving layer). The sample was subjected to a porosimeter analysis to determine an accumulated pore volume (ml/g), differentiating the data, and plotting the resultant data as frequency against a pore opening diameter (Å), to form a pore distribution curve.

The determination of a heat diffusion coefficient in the present invention is not particularly limited. For example, the coefficient can be determined according to laser flash method using LF/TCM (FA85101 B type) manufactured by Rikagaku Denki K. K. Specifically, ruby laser light is irradiated to a sample surface comprised of the components for the image receiving layer, tracing the temperature increase of the sample backside surface immediately after the irradiation, and determining the time ($t_{1/2}$) at which the temperature increase becomes a half of the maximum value. The coefficient ($\alpha$ ($cm^2$/sec)) is derived from the following equation:

$$\alpha=1.37(L^2/\pi t_{1/2})$$

In the equation, L means a thickness (cm) of a sample.

The image receiving layer of the present invention is prepared by coating a coating composition comprising a spherical precipitated calcium carbonate as a main pigment and drying it, preferably followed by surface smoothing treatment. The surface smoothing device preferably comprises a metal roll and an elastic roll meeting the following conditions (1) and (2):

(1) the surface Shore D hardness is 75 to 98 degree, preferably 80 to 98 degree, as measured according to JIS K 6301 and 7215.

(2) the surface roughness (Rmax) is 0 to 25 $\mu$m, preferably 0 to 20 $\mu$m, as measured according to JIS B 0601.

The surface treatment is carried out generally by bringing the the receiving layer into contact with a metal roll.

The determination of the surface (Shore D) hardness of an elastic roll can be carried out in accordance with JIS K 6301 and 7215, as well as the hardness test and Shore D hardness test as described in Kobunshi Jiten (Polymer dictionary) published by Asakura Shoten. The surface roughness (Rmax) (maximum height) of an elastic roll can be determined in accordance with JIS B 0601.

In the melt type heat transfer recording system, a general method for making recorded image highly defined is to enhance resolution power of a printer. This method is to increase heating sites (dots) per unit length of a head. As high definition printers, there is presently proposed a printer having 1200 dots/inch. In this case, the dot diameter is about 20 $\mu$m and a heat meltable ink image receiving layer is required to have a high smoothness.

Conventionally, it is general to use fine pigment having an average diameter of less than 1 $\mu$m as main pigment (Japanese Unexamined Application (Kokai) Nos. 60-110489 and 60-110490). However, ink image receiving layers containing conventional fine pigments have less vacant space and accordingly, insufficient ink receptivity.

When spherical precipitated calcium carbonate having an average particle diameter of 0.5 to 10$\mu$m is used like in the present invention, it is sometimes difficult to obtain a desired smoothness with conventional smoothing treatment. Thus, the present inventors have made intensive studies on smoothing devices, and as a result, have found that excellent smoothness can be obtained by treating the surface of an ink image receiving layer with a smoothing device comprising a metal roll and an elastic roll having a surface Shore D hardness of 75 to 98 degree so that the receiving layer surface is brought into contact with the metal roll, while sufficient vacant space is maintained.

When the receiving layer surface is treated so that it is brought into contact with the metal roll, the surface roughness of the elastic roll which contacts the backside of the receiving layer is considered to largely influence on the recorded image quality. The present inventors have investigated the effect of a surface roughness (Rmax), and as a result, have found that remarkably excellent recording image quality can be obtained by using a polished elastic roll having a surface Shore D hardness of 75 to 98 degree and a surface roughness Rmax of 0 to 25 $\mu$m. The material for the elastic roll can be preferably formed by, for example, cotton, epoxy resin, urethane resin and the like.

When the surface Shore D hardness of the elastic roll is less than 75 degree, the smoothness of the receiving layer surface becomes insufficient and the recording image quality is reduced, even though the surface roughness Rmax of the elastic roll is 0 to 25 $\mu$m. On the other hand, when the surface roughness Rmax of the elastic roll is larger than 25 $\mu$m, it is difficult to obtain desired recording quality, even though the surface (Shore D) hardness of the elastic roll is 75 to 98 degree.

When a receiving paper is smoothed, combination of a metal roll and an elastic roll is appropriately adjusted. A metal roll may be selected from the group consisting of a hard metal roll and a roll having a surface treated, for example, with chromium. An elastic roll may be selected from the group consisting of elastic rolls having a surface (Shore D) hardness of 75 to 98 degree. The number of pressure nips may be selected in a conventional manner.

When the smoothing treatment is carried out, it is preferable that the Bekk smoothness according to JIS P 8119 (corresponding to 10 ml) should be 400 to 2000 seconds, in order to obtain further improved recorded image quality. When the Bekk smoothness is less than 40 seconds, reproducibility such as ink transfer property is reduced and accordingly, dot loss is likely to happen. On the other hand, when the Bekk smoothness is larger than 2000 seconds, vacant space constituted of spherical precipitated calcium carbonate is likely broken with the smoothing treatment and ink receptivity is decreased, leading to decrease in image quality.

The pigment used in the present invention may include, as well as the above mentioned spherical precipitated calcium carbonate, those pigments which have been conventionally used in the manufacture of coated papers, e.g., clays such as kaolin, calcined clays such as calcined kaolin, mineral pigments such as calcium carbonate, calcium sulfate, barium sulfate, titanium dioxide, talc, zinc oxide, alumina, magnesium oxide, magnesium carbonate, silica, bentonite, zeolite and sericite, and densed or hollow fine particles made of polystyrene, urea resin, melamine resin and acrylic resin. Among them, calcined clays such as calcined kaolin are preferably used.

The spherical precipitated calcium carbonate is preferably used in an amount of 50 to 100 wt. %, more preferably 60 to 100 wt. % based on the total pigment component. When the amount of such spherical precipitated calcium carbonate is less than 50 wt. %, the ink receptivity is insufficient and it is not possible to obtain desired recorded image.

The binder used in a coating composition for a receiving paper includes water-soluble or water-dispersible polymer, e.g., starch such as cationated starch, amphoteric starch, oxidized starch, enzyme treated starch, heat chemically modified starch, esterified starch, etherified starch; cellulose derivatives such as carboxy methyl cellulose and hydroxy ethyl cellulose; natural or semi-natural polymer such as gelatin, casein, soy bean protein and natural rubber; polyvinyl alcohol; polydienes of such as isoprene, neoprene and butadiene; polyalkenes such as polybutene, polyisobutylene, polypropylene and polyethylene; vinyl polymers or copolymers of vinyl halide, vinyl acetate, styrene, (meth)acrylic acid, (meth)acrylate, (meth)acrylamide and methylvinylether; synthetic rubber latex of styrene-butadiene and methylmethacrylate-butadiene; and synthetic polymer such as polyurethane, polyester, polyamide, olefin-maleic anhydride resin and melamine resin. These binders may be used singly or in combination of two or more of them, depending on the quality of the receiving paper to be obtained.

The binder is generally used in an amount of 5 to 40 parts by weight based on 100 parts by weight of a pigment. When the amount of the binder is less than 5 parts by weight, the surface strength of the image receiving layer is weak and accordingly, the problem such as dot shape deformation is likely to happen. On the other hand, when the amount of the binder of the receiving layer is larger than 40 parts by weight, the vacant space constituted of spherical precipitated calcium carbonate becomes filled and accordingly, ink receptivity is remarkably reduced and it is not possible to obtain desired recorded image.

The coating composition may contain other additives such as surfactants, pH adjusters, viscosity adjusters, softeners, gloss imparting agents, waxes, dispersants, flow modifiers, anti-conductive agents, stabilizers, anti-static agents, cross-linking agents, sizing agents, fluorescent whiteners, coloring agents, ultraviolet ray absorbers, anti-foaming agents, water-resistant agents, plasticizers, lubricants, antiseptic agents and fragrances.

The coating amount of the coating composition may be varied depending on the use of the present receiving paper. In general, it is necessary to completely cover fibers on the paper surface. The coating amount is preferably 6 to 30 $g/m^2$, more preferably 10 to 30 $g/m^2$ on the dry basis on one side. The coating composition can be applied to the receiving paper using conventional coating devices such as blade coater, air knife coater, roll coater, reverse roll coater, bar coater, curtain coater, die slot coater, gravure coater, champlex coater, brush coater, two roll or meter blade type sizing coater, billblade coater, short dwell coater and gate roll coater. These devices are conventionally used as on-demand coater or off-demand coater.

The receiving paper of the present invention is generally finished so that the water content after conventional drying step or before surface treatment step is 3 to 10 wt. %, preferably 4 to 8 wt. %.

The image receiving layer of the present invention may be plurally used to form a multiple structure, if necessary. In this case, the coating composition for forming each layer may be different from the coating composition for forming other layer. The coating compositions may be selected depending on degree of quality thereof.

The back side of the base paper to be coated in the present invention may be provided with a synthetic resin layer, a coating comprised of a pigment and a binder, and an anti-static layer so as to inhibit curl, improve a printing property or improve feeding ability of papers. Further, the back side of the base paper may be treated, such as post-treated in order to provide stickiness, magnetic property, flame retardance, heat-resistance, water-resistance, oil-resistance and non-slip property, thereby imparting usage suitability to the base paper.

The pigment to be used in the base paper is not limited and includes mineral fillers such as talc, kaolin, clay, calcined kaolin, deramikaolin, ground calcium carbonate, precipitated calcium carbonate, magnesium carbonate, titanium oxide, aluminum hydroxide, calcium hydroxide, magnesium hydroxide, zinc hydroxide, magnesium sulfate, magnesium silicate, calcium sulfate, calcium silicate, white carbon, aluminosilicate, silica, sericite and smectite, as well as organic synthetic fillers, e.g., dense or hollow fine particles made of resins such as polystyrene resin, urea-formaldehyde resin, vinylidene chloride resin and benzoguanamine resin. The pigments contained in used papers or brokens may be used as a recycled material.

The surface of the image receiving paper of the present invention may be sized with an aqueous binder or an aqueous binder containing a pigment. The aqueous binder includes a water-soluble or -dispersible polymer as used as a binder in the coating composition for forming the receiving paper as stated above.

In the base paper used in the present invenition, there may be used conventional additives to be added inside of the paper.as well as pulp fibers and the fillers as stated above, so long as they do not adversely affect the effect of the present invention. Such additives include anionic, cationic or amphoteric yield-improvers, filtered water improvers, paper strength improvers and sizing agents. Further, there may be used additives to be added inside of the paper such dyes, fluorescent whiteners, pH adjusters, anti-foaming agents, pitch control agents and slime control agents, depending on the usage of the paper.

The process for paper making is not limited and includes all the paper making processes such as acid paper making process wherein the paper making is carried out at a pH of about 4.5 and a neutral paper making process wherein alkaline fillers such as calcium carbonate are used mainly as a pigment and wherein the paper making is conducted at a pH from a weak acidic state of about 6 to a weak alkaline state of about 9. The paper making machines include wire paper machine, twin wire machine, cylinder wire machine and Yankee machine.

EXAMPLE

The present invention will be further illustrated by way of working examples. However, these examples should not be considered to restrict the scope of the present invention. In the following examples, the terms "part" and "%" should be read by weight, otherwise specifically indicated.

Example 1

Preparation of Base Paper

To 100 parts of an NBKP pulp slurry (freeness of 480 ml), there were added 20 parts of talc as a pigment, 1.5 part of rosin emulsion sizing agent and 2 parts of aluminum sulfate. The resultant mixture was diluted with white water to produce a paper forming composition having a pH of 5.3 and a solid content of 1.1%. The paper forming composition was subjected to wire paper machine to prepare paper, to which oxidized starch (tradename: Ace A manufactured by Oji Corn Starch) was coated using a sizing press device so that the dry coating amount was 4.0 g/m$^2$, and then dried and surface-treated with a machine calender, to form a base paper having a smoothness of 80 second and a basis weight of 97 g/m$^2$.

Preparation of Coating Composition for Forming Image Receiving Layer 100 parts of spherical precipitated calcium carbonate (tradename: ED-III, manufactured by Komesho Sekkai Kogyo) having an average particle diameter of 3.0 $\mu$m (the primary particle is of cubic form and has one side of about 0.2 $\mu$m in length) was added to 0.5 part (solid content) of sodium polyacrylate (tradename: Aron A-9, manufactured by Toa Gosei) as a dispersant. The resultant mixture was dispersed in water using Cowles Dissolver device to form a pigment slurry. To this slurry, added was 12 parts of polyvinyl alcohol and one part of styrene-butadiene copolymer latex and stirred, and then water was added thereto, to form a coating composition having a solid content of 50%.

Preparation of Image Receiving Layer

The coating composition was coated onto one side of the base paper as prepared above using a bar coater, so that the dry coating amount was 15 g/m$^2$, and then dried to a water content of 7%, to prepare an image receiving paper.

Smoothing Treatment

Metal roll: Planished hard metal roll

Elastic roll: Newcotton roll (tradename, manufactured by Yuriroll Kikai)
Hardness (Shore D): 85 degree
Surface roughness Rmax: 10 $\mu$m
Material: cotton Using a smoothing device employing a combination of the above rolls, the image receiving layer was treated so that the surface of the receiving layer was brought into contact with the metal roll to give a Bekk smoothness of 800 seconds, whereby providing a receiving paper.

Example 2

Example 1 was repeated except that the pigment used in the coating composition was changed to spherical precipitated calcium carbonate (tradename: ED-I, manufactured by Komesho Sekkai Kogyo) having an average particle diameter of 1.0 $\mu$m and that the elastic roll used in the smoothing treatment was changed to the following elastic roll, to prepare a receiving paper.

Elastic roll: Normalcotton (tradename, manufactured by Yuriroll Kikai)
Hardness (Shore D): 80 degree
Surface roughness Rmax: 20 $\mu$m
Material: cotton Example 3

Example 1 was repeated except that the pigment used in the coating composition was changed to spherical precipitated calcium carbonate (tradename: ED-111, manufactured by Komesho Sekkai Kogyo) having an average particle diameter of 5.0 $\mu$m and that the elastic roll used in the smoothing treatment was changed to the following elastic roll, to prepare a receiving paper.

Elastic roll: Mirrormax roll (tradename, manufactured by Yamauchi Co., Ltd.)
Hardness (Shore D): 90 degree
Surface roughness Rmax: 10 $\mu$m
Material: epoxy resin Example 4

Example 3 was repeated except that the pigment used in the coating composition was changed to spherical precipitated calcium carbonate (tradename: B-1002, manufactured by Tsukumi Fine Ceramics Kenkyu Center) having an average particle diameter of 10.0 $\mu$m, to prepare a receiving paper.

Example 5

Example 1 was repeated except that the pigment used in the coating composition was changed to 80 parts of spherical precipitated calcium carbonate (tradename: ED-III, manufactured by Komesho Sekkai Kogyo) having an average particle diameter of 3.0 $\mu$m and 20 parts of calcined clay (tradename: Ancilex 93 manufactured by Engelhard) having an average particle diameter of 0.4 $\mu$m and except that a combination of a metal roll and an elastic roll was changed as follows.

Metal roll: Chrome plated hard metal roll

Elastic roll: Elaglass roll (tradename, manufactured by Kinyo-Sha)
Hardness (Shore D): 94 degree
Surface roughness Rmax: 6 $\mu$m
Material: Urethane resin Using a smoothing device employing a combination of the above rolls, the image receiving layer was treated so that the surface of the receiving layer was brought into contact with the metal roll to give a Bekk smoothness of 1500 seconds, whereby providing a receiving paper.

Example 6

Example 1 was repeated except that the pigment used in the coating composition was changed to 60 parts of spherical precipitated calcium carbonate (tradename: ED-III, manufactured by Komesho Sekkai Kogyo) having an average particle diameter of 3.0 $\mu$m and 40 parts of calcined clay (tradename: Ancilex 93 manufactured by Engelhard) having an average particle diameter of 0.4 $\mu$m, to prepare a receiving paper.

Example 7

Example 1 was repeated except that the pigment used in the coating composition was changed to 80 parts of spherical precipitated calcium carbonate (tradename: ED-III, manufactured by Komesho Sekkai Kogyo) having an average particle diameter of 3.0 $\mu$m and 20 parts of silica (tradename: Mizucasil P-705 manufactured by Mizusawa Kagaku) having an average particle diameter of 1.5 $\mu$m, to prepare a receiving paper.

Comparative Example 1

Example 1 was repeated except that the elastic roll used in the smoothing treatment was changed to the following elastic roll, to prepare a receiving paper.

Elastic roll: Newcotton roll (tradename, manufactured by Yuriroll Kikai)

Hardness (Shore D): 85 degree
Surface roughness Rmax: 30 μm
Material: cotton

Comparative Example 2

Example 1 was repeated except that the elastic roll used in the smoothing treatment was changed to the following elastic roll, to prepare a receiving paper.

Elastic roll: Elaglass roll (tradename, manufactured by Kinyo-Sha)
Hardness (Shore D): 60 degree
Surface roughness Rmax: 20 μm
Material: Urethane rubber Using a smoothing device employing a combination of the above rolls, the image receiving layer was treated so that the surface of the receiving layer was brought into contact with the metal roll, but the Bekk smoothness of the image receiving layer was as low as 400 seconds.

Comparative Example 3

Example 5 was repeated except that the pigment used in the coating composition was changed to spherical precipitated calcium carbonate (tradename: B-1501, manufactured by Tsukumi Fine Ceramics Kenkyu Center) having an average particle diameter of 15.0 μm and the smoothing treatment was conducted so that the Bekk smoothness was 800 seconds, to prepare a receiving paper.

Comparative Examples 4 to 6

Example 1 was repeated except that the pigment used in the coating composition was changed to column like precipitated calcium carbonate having an average particle diameter of 0.6 μm (tradename: TP-123 cs, manufactured by Okutama Kogyo) (Comparative Example 4); to calcined clay having an average particle diameter of 0.4 μm (tradename: Ancilex 93, manufactured by Engelhard) (Comparative Example 5); and to hexagonal plate like kaolin having an average particle diameter of 0.2 μm (tradename: UW-90, manufactured by Engelhard) (Comparative Example 6), to prepare receiving papers.

EVALUATION METHOD

[Average particle diameter]

The average particle diameter of the pigment was determined based on the observation with electron microscope.

[Shore D hardness]

The hardness (Shore D) of the elastic roll was determined according to JIS K 6301 and JIS K 7215.

[Surface roughness]

The surface roughness Rmax (maximum height) of the elastic roll was determined according to JIS B 0601. The surface roughness Rmax of the receiving paper was determined in the same manner as above.

[Bekk smoothness]

The Bekk smoothness of the image receiving layer surface was determined according to JIS P 8119.

[Average pore open area and Pore open area ratio]

A photograph was taken of the ink image receiving layer surface using a scanning electron microscope (×1000) and then the average pore open area and the pore open area ratio were determined with Image Analyzer V10 manufactured by Toyobo Co., Ltd.

The pore open area ratio means a ratio of the total area occupied by the pore open portion or area per the total area on the porous ink image receiving layer surface. This is expressed by the following equation.

Pore open area ratio (%)=(total area occupied by pore open portion or area)/(total area of ink image receiving layer surface)×100

[Pore distribution determination]

The pore distribution (differential curve) of the image receiving layer of the receiving paper can be determined by calculation based on a vacant space volume distribution curve measured according to mercury pressure penetration method using a porosimeter (tradename: Micrometric Pore-sizer 9320, manufactured by Shimazu Seisaku-sho). The peak position (μm) of the pore diameters was determined based on the pore distribution curve and a percent proportion of the total accumulated pore volume of the pores having a pore diameter of 0.8 to 6 μm per total accumulated pore volume in an image receiving layer was indicated as pore volume %.

[Heat diffusion coefficient of image receiving layer components]

A coating composition for forming an ink image receiving layer as a sample was cast into an O-ring (a line diameter of 3 mm and an outer diameter of 100 mm) on a calcined ceramic absorbing plate (manufactured by Nikkato K. K.) and its surface was flattened by a metal plate. The coating composition was defoamed under reduced pressure and then dried at room temperature for 48 hr. Then, the resultant coating was cut at its edge by a razor to prepare a test specimen having a diameter of 7 to 8 mm. The whole surface of the specimen was coated with carbon by spraying and the heat diffusion coefficient of the specimen was determined using a laser flash heat constant measuring device manufactured by K. K. Rigaku.

Laser pulse: 500 μsec.
Charge voltage: 2.5 kV
Atmosphere: 20° C. and 0.15 torr or less vaccuum
Temperature detecting: Infrared sensing

[Evaluation of dot reproducibility of recorded image]

Using a commercially available heat transfer color printer (tradename: CH-7204 manufactured by Seiko Denshi Kogyo), image recording was carried out. The single color (cyan) dot portion of the recorded image was enlarged by 30 times with an analyzer (DA-3000) and observed in respect of degree of dot loss and dot sharpness (broadening or narrowing of dot shape) based on the following criteria:

◎: no dot loss and dot broadening or narrowing of dot shape and accordingly, excellent for practical use
○: substantially no dot loss and dot broadening or narrowing of dot shape and accordingly, substantially no problem for practical use
Δ: significant amount of dot loss and dot broadening or narrowing and accordingly, insufficient for practical use
X : much dot loss and dot broadening or narrowing and accordingly, unsuitable for practical use

[Evaluation of double superimposed printed image]

Using the same color printer as used in the above evaluation, a dot of a single color of cyan was printed and thereon a second dot of a single color of magenta was printed. The superimposed image portion of the resultant printed image was enlarged by 30 times with an analyzer (DA-3000) and the dot shape of the first printed cyan color was observed in respect of the degree of dot broadening or narrowing based on the following criteria:

◎: no dot broadening or narrowing and accordingly, excellent for practical use
603 : substantially no dot broadening or narrowing and accordingly, substantially no problem in practical use

66 : significant amount of dot broadening or narrowing and accordingly, insufficient for practical use X : much dot broadening or narrowing and accordingly, unsuitable for practical use

[Evaluation of image quality of recorded image]

Using the same color printer as used in the above evaluation, full color printing was made. The superimposed (triple-colored) portion was observed and collectively evaluated in respect of quality of recorded image based on the following criteria:

⊙: no color shift and color density unevenness and very clear image, and accordingly, excellent in image quality ○: substantially no color shift and color density unevenness and clear image, and accordingly, good in image quality Δ: some amount of color shift and color density unevenness and less clear image, and accordingly, insufficient in image quality X : some amount of color shift and color density unevenness and much less clear image, and accordingly, very insufficient in image quality In the above evaluations, the score equal to or higher than ○ means suitablity for practical use, while the score equal to or lower than Δ means unsuitability for practical use.

TABLE 1

| | Pigment | | | Elastic roll | |
|---|---|---|---|---|---|
| Ex. No. | Shape | Average Particle Diameter (μm) | Metal roll Surface Treatment | Shore Hardness (degree) | Surface Roughness Rmax (μm) |
| 1 | Sphere | 3.0 | No | 85 | 10 |
| 2 | Sphere | 1.0 | No | 80 | 20 |
| 3 | Sphere | 5.0 | No | 90 | 10 |
| 4 | Sphere | 10.0 | No | 90 | 10 |
| 5 | Sphere | 3.0 | | | |
| | Undetermined form | 0.4 | Chrome plated | 94 | 6 |
| 6 | Sphere | 3.0 | | | |
| | Undetermined form | 0.4 | No | 85 | 10 |
| 7 | Sphere | 3.0 | | | |
| | Undetermined form | 1.5 | No | 85 | 10 |
| Com. Ex. | | | | | |
| 1 | Sphere | 3.0 | No | 85 | 30 |
| 2 | Sphere | 3.0 | No | 60 | 20 |
| 3 | Sphere | 15.0 | Chrome plated | 94 | 6 |
| 4 | Column | 0.6 | No | 85 | 10 |
| 5 | Undetermined form | 0.4 | No | 85 | 10 |
| 6 | Plate | 0.2 | No | 85 | 10 |

TABLE 2

| | Image receiving layer physical property | | | | | |
|---|---|---|---|---|---|---|
| Ex. No. | Surface Roughness Rmax (μm) | Pore open area ratio (%) | Average pore open area ($\mu m^2$) | Pore diameter peak position (μm) | Pore volume ratio (%) | Heat diffusion coef. $10^{-3}$ $cm^2$/sec |
| 1 | 10 | 68 | 3.5 | 1.6/1.8 | 85 | 1.5 |
| 2 | 10 | 50 | 1.0 | 1.2 | 75 | 1.9 |

TABLE 2-continued

| | Image receiving layer physical property | | | | | |
|---|---|---|---|---|---|---|
| Ex. No. | Surface Roughness Rmax (μm) | Pore open area ratio (%) | Average pore open area ($\mu m^2$) | Pore diameter peak position (μm) | Pore volume ratio (%) | Heat diffusion coef. $10^{-3}$ $cm^2$/sec |
| 3 | 12 | 70 | 6.0 | 3.5 | 70 | 1.3 |
| 4 | 13 | 80 | 12.0 | 8.0 | 45 | 1.2 |
| 5 | 8 | 62 | 3.0 | 1.6/1.8 0.4 | 65 | 1.7 |
| 6 | 7 | 50 | 2.0 | 1.6/1.8 0.4 | 45 | 2.1 |
| 7 | 8 | 65 | 3.0 | 1.6/1.8 | 70 | 1.5 |
| Com. Ex. | | | | | | |
| 1 | 20 | 70 | 4.0 | 1.6/1.8 | 85 | 1.5 |
| 2 | 17 | 70 | 4.0 | 1.6/1.8 | 85 | 1.5 |
| 3 | 12 | 90 | 12.0 | 14.0 | 20 | 1.3 |
| 4 | 10 | 26 | 0.1 | 0.2 | 10 | 2.5 |
| 5 | 10 | 15 | 0.1 | 0.3 | 10 | 1.9 |
| 6 | 10 | 10 | 0.05 | 0.2 | 10 | 3.9 |

TABLE 3

| | Recorded image quality | | |
|---|---|---|---|
| Ex.No. | Dot reproducibility | Two color superimposed printing | Image quality |
| 1 | ⊙ | | |
| 2 | ⊙ | ○ | ○ |
| 3 | ○ | ⊙ | ○ |
| 4 | ○ | ○ | ○ |
| 5 | ⊙ | ⊙ | ⊙ |
| 6 | ⊙ | ○ | ○ |
| 7 | ⊙ | ⊙ | ⊙ |
| Com.Ex. | | | |
| 1 | x | ⊙ | Δ |
| 2 | x | ⊙ | x |
| 3 | Δ | ⊙ | Δ |
| 4 | Δ | x | Δ |
| 5 | Δ | x | x |
| 6 | x | x | x |

The receiving paper of the present invention provides no dot broadening, dot bridging and dot loss in the recorded image and therefore is excellent in dot reproducibility and high in performance and quality for full color recording paper. Accordingly, the present receiving paper is very useful for practical use.

What is claimed is:

1. A receiving paper for melt-type heat transfer recording comprising a base paper and an image receiving layer thereon, said receiving layer containing a binder and a pigment and receiving a heat-meltable ink, wherein said receiving layer contains spherical precipitated calcium carbonate having an average particle diameter of 0.5 to 10 μm as a pigment, and wherein the surface of said receiving layer has a surface roughness (Rmax) of 0 to 15 μm as measured according to JIS B 0601, a pore open area ratio of 30 to 85% and an average pore open area of 0.5 to 20.0 $\mu m^2$.

2. The receiving paper of claim 1 wherein said spherical precipitated calcium carbonate has an average particle diameter of 0.5 to 6 μm.

3. The receiving paper of claim 2 wherein said spherical precipitated calcium carbonate has an average particle diameter of 1 to 6 μm.

4. The receiving paper of claim 1 wherein said spherical precipitated calcium carbonate is spherical aggregate composed of cubic fine particles having one side of 0.05 to 0.8 $\mu$m in length.

5. The receiving paper of claim 1 wherein the surface of said receiving layer has a surface roughness (Rmax) of 0 to 13 $\mu$m as measured according to JIS K 0601.

6. The receiving paper of claim 1 wherein the surface of said receiving layer has a pore open area ratio of 50 to 85%.

7. The receiving paper of claim 1 wherein the surface of said receiving layer has an average pore open area of 0.5 to 15 $\mu m^2$.

8. The receiving paper of claim 1 wherein said spherical precipitated calcium carbonate is used in an amount of 50 to 100 wt. % based on the total amount of the pigment component.

9. The receiving paper of claim 8 wherein said spherical precipitated calcium carbonate is used in an amount of 60 to 100 wt. % based on the total amount of the pigment component.

10. The receiving paper of claim 1 wherein said receiving layer further contains a pigment other than said spherical precipitated calcium carbonate.

11. The receiving paper of claim 10 wherein said other pigment is calcined clay.

12. The receiving paper of claim 1 wherein said receiving layer has a percent proportion of accumulated pore volume of pores having a pore diameter of 0.8 to 6 $\mu$m per total accumulated pore volume being 40 to 100% and wherein the components of said receiving layer have a heat diffusion coefficient of $1.0\times10^{-3}$ to $2.4\times10^{31\ 3}$ $cm^2$/sec.

13. The receiving paper of claim 12 wherein said percent proportion of accumulated pore volume of pores having a pore diameter of 0.8 to 6 $\mu$m per total accumulated pore volume is 60 to 100%.

14. The receiving paper of claim 12 wherein said heat diffusion coefficient is 1.0 to $2.0\times10^{31}$ $'cm^2$ /sec.

15. The receiving paper of claim 1 wherein the surface of said receiving layer is treated with a metal roll of a smoothing device comprising said roll and an elastic roll meeting the following conditions (1) and (2):

(1) the surface Shore D hardness is 75 to 98 degree as measured according to JIS K 6301 and 7215.

(2) the surface roughness (Rmax) is 0 to 25 $\mu$m as measured according to JIS B 0601.

16. The receiving paper of claim 15 wherein the surface Shore D hardness of said elastic roll is 80 to 98 degree as measured according to JIS K 6301 and 7215.

17. The receiving paper of claim 15 wherein the surface roughness Rmax of said elastic roll is 0 to 20 $\mu$m as measured according to JIS B 0601.

* * * * *